US005722203A

United States Patent [19]

Staples et al.

[11] Patent Number: 5,722,203

[45] Date of Patent: Mar. 3, 1998

[54] PREHUNG DOOR INSTALLATION AID

[76] Inventors: Donald E. Staples, 118A N. Main St., Cape Girardeau, Mo. 63701; J. Christian Staples, 4570 Brairgate, St. Charles, Mo. 63304; Jeffrey T. Staples, 2403 Ripplemeade, Herndon, Va. 22071

[21] Appl. No.: 709,909

[22] Filed: Sep. 9, 1996

[51] Int. Cl.[6] ..... E06B 1/00

[52] U.S. Cl. ..... 49/380

[58] Field of Search ..... 49/380, 503, 504; 206/321, 325

[56] References Cited

U.S. PATENT DOCUMENTS

| | | | |
|---|---|---|---|
| D. 319,007 | 8/1991 | Rogers et al. . | |
| 2,720,308 | 10/1955 | Howell | 49/380 |
| 2,728,956 | 1/1956 | Jackson | 49/380 |
| 3,584,416 | 6/1971 | Baumgartel . | |
| 3,593,458 | 7/1971 | Wahlfeld | 49/380 |
| 4,001,972 | 1/1977 | Hurwitz . | |
| 4,483,101 | 11/1984 | Berzina . | |
| 4,718,195 | 1/1988 | Ortega . | |
| 4,739,561 | 4/1988 | Mills . | |
| 4,884,687 | 12/1989 | Steves . | |
| 5,159,782 | 11/1992 | Sales . | |
| 5,209,017 | 5/1993 | Ridge . | |
| 5,562,315 | 10/1996 | Sales | 49/380 X |

*Primary Examiner*—Jerry Redman

*Attorney, Agent, or Firm*—Polster, Lieder, Woodruff & Lucchesi

[57] ABSTRACT

An installation aid is provided for maintaining a door closed and square relative to a door frame in which the door is hung during installation of a door assembly in a doorway. The installation aid includes a first portion and a second portion which are connected together by a screw when the installation aid is installed in the door assembly. The first portion includes a head which is received in a door knob hole of the door and a post which extends through a door knob bolt hole of the door. The second portion includes a base which is secured to an outer surface of the strike jamb and a post which extends through a lock hole of the strike jamb. The posts of the first and second portions are telescopically interconnected and include screw holes which are axially aligned when the door is closed. The screw hole of the first portion is off-set from a vertical axis of the first portion so that the screw hole will be closer, for example, to the front surface of the door than to the back surface of the door. After the door assembly is installed, the first portion is removed from the door. The second portion remains on the strike jamb.

21 Claims, 3 Drawing Sheets

PREHUNG DOOR INSTALLATION AID

BACKGROUND OF THE APPLICATION

This invention relates to doors which are prehung on a door frame, and, in particular to an installation aid which will hold the door closed and square during shipping, delivery, and installation of the prehung door.

The building industry has, for many years, provided to contractors, carpenters, and do-it-yourselfers doors that are prehung on wood frames. The prehung door typically includes a door, a door frame, and two or three hinges which connect the door to the frame. The frame is typically wooden and may be a single frame or a two-piece split frame. The machining of the door and frame to accept the hinges and preparation of the lock and strike are done in a manufacturing facility using equipment specifically designed for this purpose. In addition, interior casing is usually installed on either one side of the door if it is installed on a flat one-piece frame, or on both sides, if the door in installed in a split frame. During production of the door assembly, the complete door frame, consisting of two side jambs and a head jamb are nailed together to form a frame around three sides of the door. The top jamb spans the distance between the side jambs at their tops, but nothing connects the side jambs along their bottoms. The side jambs can thus swing relative to each other. The manufacturer machines for, and installs, the hinges on both the door and the frame.

When the complete frame is assembled, the hinges provide proper spacing between the door and the hinge jamb. However, when the other jamb (the strike jamb) is attached to the head jamb, there is nothing to secure it relative to the door. The strike jamb and the head jamb can thus move relative to the door and hinge jamb. To overcome this, many manufacturers use one or two dual headed nails and drive the nails through the back of the strike jamb into the door to temporarily hold the door and the strike jamb in position relative to each other for purposes of shipping. Because the nails have to be removed prior to installation of the door assembly, the manufacturer generally makes no effort to square the door in the frame. Therefore, as part of the installation process, the door installer must square the door in the door frame so that the door will operate properly and easily. When the nails are removed, there is nothing holding the strike jamb in place relative to the door or the hinge jamb. As a result, the prehung door assembly is difficult handle, and thus is difficult to hang and square. Further, it is difficult to obtain the proper spacing between the door and the frame members. All this also makes it exceedingly difficult for one person to install the door unit by himself. Additionally, the use of the nails leaves undesirable nail holes in the door and the strike jamb.

Other retaining devices have been provided to hold the door closed for handling and shipping and to eliminate the holes in the door and jamb created by the dual headed nails. However, most retaining devices, like the dual headed nails, must be removed prior to installation of the door in a doorway. As with the dual headed nails, once these devices are removed from the door assembly, there is nothing to hold the unit together and to hold the door square in the frame. These devices therefore do not make installation of the door assembly any easier.

SUMMARY OF THE INVENTION

One object of the present invention is to provide a prehung door installation aid which will facilitate installation of a prehung door in a doorway.

Another object is to provide such an aid which remains in the door during installation of the door in the doorway to maintain the door closed and square in its door frame and to maintain proper alignment between the door and frame members or door jambs.

These and other objects will become apparent to those skilled in the art in light of the following disclosure and accompanying drawings.

In accordance with the invention, generally stated, an installation aid is provided which will maintain a door closed and square in a door frame during installation of a door assembly in a building. As is common, the door assembly includes the door and the door frame. The door frame has a hinge jamb, a strike jamb, and an top jamb, which extends between and connects the hinge and strike jambs at the tops thereof. There is no bottom member which connects the bottoms of the side jambs together. The door is hingedly connected to the hinge jamb. The door has a front and a back surface and a leading edge which is proximate the strike jamb when the door is closed. A first hole adjacent the leading edge extends between the front and back surfaces for accepting a door knob assembly. A second hole for a bolt of the door knob assembly extends inwardly from the leading edge of the door and communicates with the first hole. The strike jamb has a hole extending therethrough and which is aligned with the door's second hole when the door is closed in the frame.

The installation aid includes a first portion and a second portion which are connected by a fastener when the aid is installed in the door assembly. The first portion is received in the door's first hole and extends through the door second hole and has a screw hole which is generally parallel to a axis of the door second hole. The second portion is secured to an outer surface of the strike jamb to cover the strike jamb hole and has a screw hole which is axially aligned with the first portion screw hole when the door is closed. The fastener extends through the first and second portion screw holes to removably connect the first and second portions to maintain the door closed during installation of the door assembly in a structure. When the two portions of the aid are connected, the aid will maintain the strike jamb in position against the door. Thus, the strike jamb will not be able to move relative to the other frame members. The installation aid is left in the door assembly during installation of the assembly in a doorway, and the second portion remains on the strike jamb after the door assembly is installed in a structure.

The second portion includes a base which covers the strike jamb hole and a post which extends into the strike jamb hole. The post has a groove to define an inner post. The second portion's screw hole extends through the inner post. The first portion includes a head having an front surface and a back surface and a hollow post which extends from the head front surface through the door second hole. The hollow post of the first portion is telescopically received in the second portion groove and has a wall sized and shaped to be received in the second portion groove. The screw holes of the first and second portions are off-set from a vertical axis of the first and second portions such that the screw holes will be closer to one of the door's front and back surfaces than to the other. This positioning of the screw holes eases driving of the fastener through the screw holes. Preferably, the top surface of the second portion's inner post is concave. The deepest portion of the concave surface is aligned with the second portion screw hole to guide the screw into the screw hole.

The post of the first portion includes a first post and a second narrower post. The second post is coaxial with the first post. The first and second posts of the first portion define a shoulder and a key extends axially along the second post. The installation aid second portion includes a key way which receives the key of the first portion. The key and key way are positioned to align the first portion screw hole with the second portion screw hole when the installation aid is installed in a door. The second portion base includes a top, a bottom, and sides. A cutout is formed in one of the base sides to facilitate proper positioning of the second portion on the strike jamb.

DESCRIPTION OF THE PREFERRED EMBODIMENT

Figure 1:
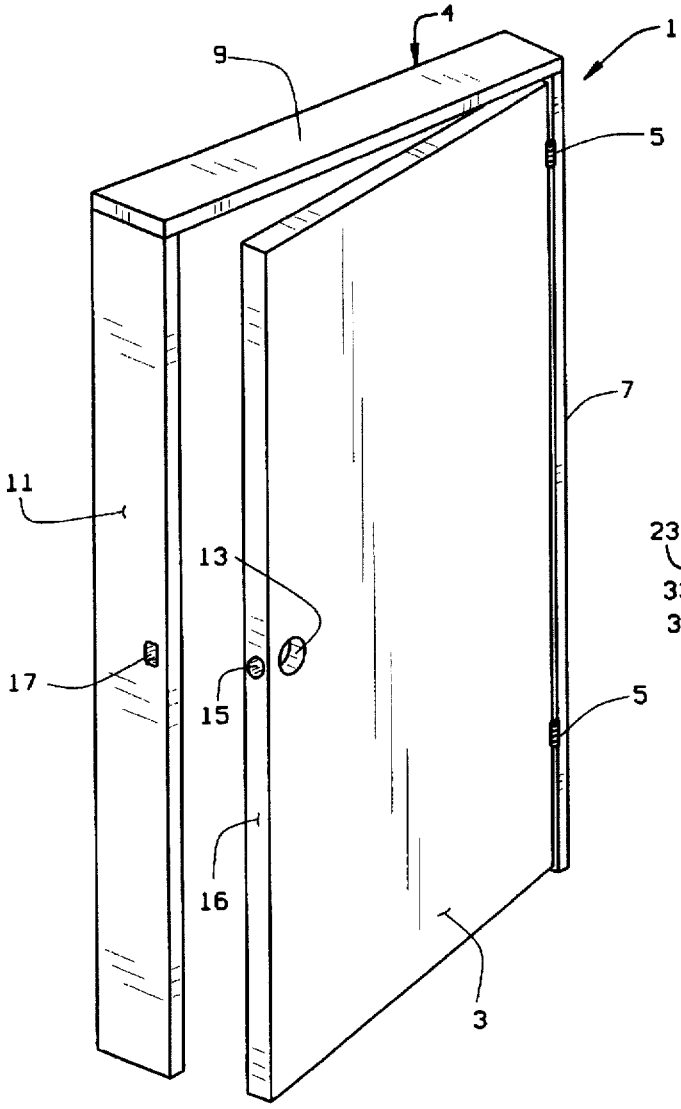
FIG. 1 is a perspective view of a typical prehung door assembly.

A typical prehung door assembly or unit 1 is shown generally in FIG. 1. The unit 1 includes a door 3 which is mounted in a frame 4. The frame includes a hinge jamb 7, to which the door is mounted by hinges 5, a head jamb 9, and a strike jamb 11. The head jamb 9 extends across the top of the door to connect the hinge and strike jambs 7 and 11. As can be seen, there is nothing which connects the bottoms of the hinge and strike jambs to maintain the door assembly square and the strike jamb 11 can thus move relative to the door 3 and the other frame members 7 and 9. The door 3 includes a hole 13 which extends between the front and back faces of the door, as is known, to install a door knob in the door. A second hole 15 is formed in a leading edge 16 of the door and communicates with the knob hole 13 to allow for the bolt of the door knob assembly to be installed in the door. The strike jamb 11 has a hole 17 positioned to be aligned with the door knob bolt hole 15, as is known, to provide a hole in the jamb 11 into which the door knob bolt can extend to secure the door in its closed position.

Figure 2B:
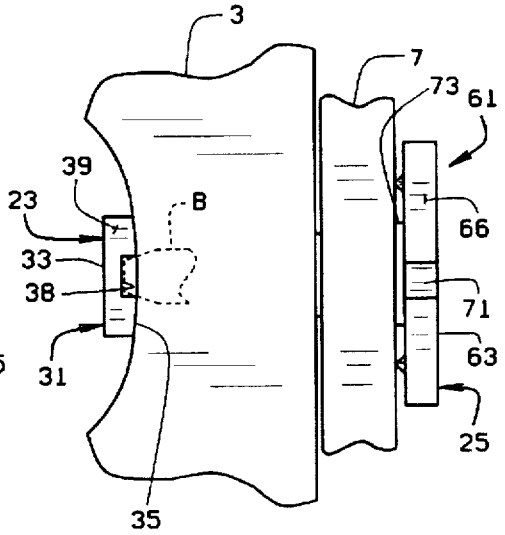
FIG. 2B is a front elevational view of the installation aid received in a door, the door being closed in its frame, and showing a tool adapted to facilitate removal of a first portion of the installation aid from the door.
Figure 2A:
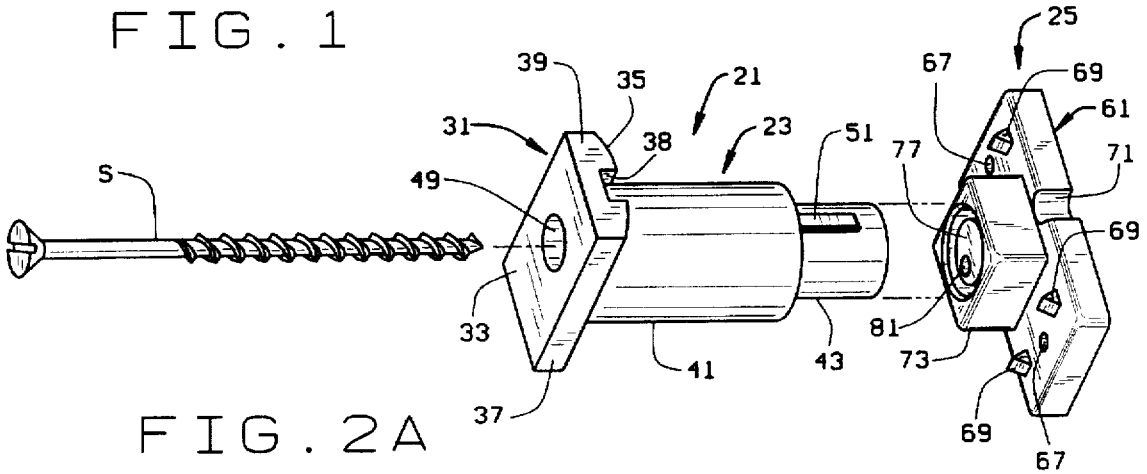
FIG. 2A is an exploded perspective view of an installation aid of the present invention.

As shown in FIG. 2A, an installation aid 21 of the present invention includes a first portion 23 and a second portion 25. The first portion 23 is received in the door 3, is passed into through the door knob bolt hole 15 through the opening 13 in the door 3, and extends beyond the door edge 16 to extend into the jamb hole 17. The second portion 25 is received in the jamb hole 17 and receives the first portion 23, as will be explained below. The two portions are connected by a fastener and cooperate to hold the strike jamb 11 in position relative to the door and other frame members. Thus, the aid 21, when installed in the door assembly 1, will positionally fix the strike jamb 11 with respect to the door and the other frame members. Importantly, the installation aid is left in the door assembly 1 while the door assembly is being installed in a doorway. Thus, the door assembly 1 can be squared by the manufacturer and maintained in the square state. Further, because the strike jamb will not be free to move with the installation aid installed in the door assembly, one individual can install the door by himself.

The first portion 23 of the installation aid is shown in detail in FIGS. 4–8. The first portion 23 includes a head 31 having a generally flat and planar back surface 33, a curved front surface 35, top and bottom surfaces 37, and side surfaces 39. The curvature of the front surface 35 is shaped to correspond to the curvature of the hole 13 in the door, so that when the portion 23 is installed in the door, the surface 35 will be flush with the edge of the hole 13. Slots 38 are formed in the sides 39 adjacent the surface 35. The slots 38 are sized and shaped to allow the blade B of a screwdriver to fit in them to facilitate removal of the portion 23 from a door assembly after the assembly 1 has been installed in a doorway, as will be explained below.

Figure 3:
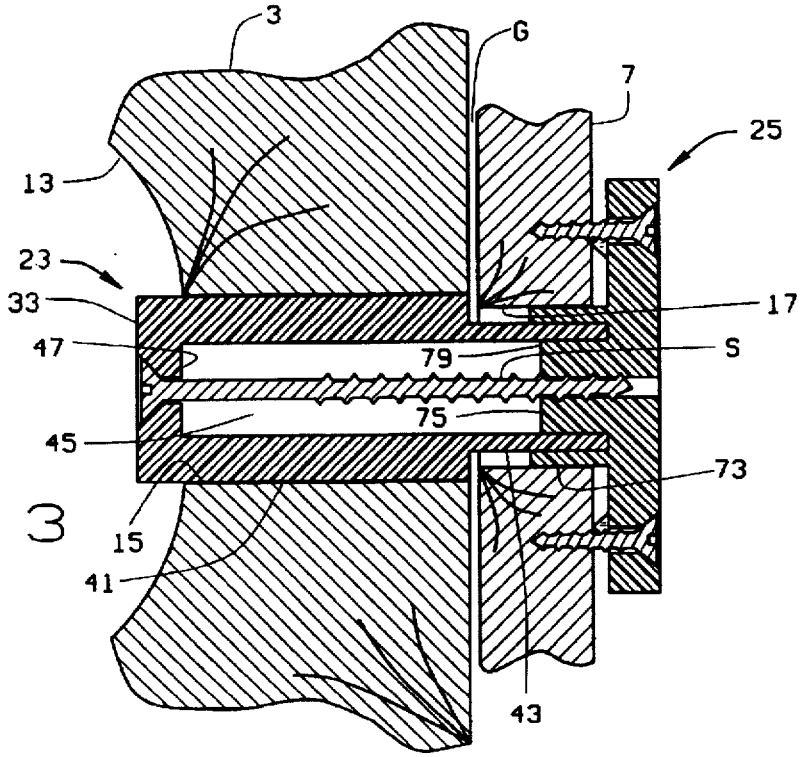
FIG. 3 is a cross-sectional view of the installation aid in position in the prehung door assembly.
Figure 4:
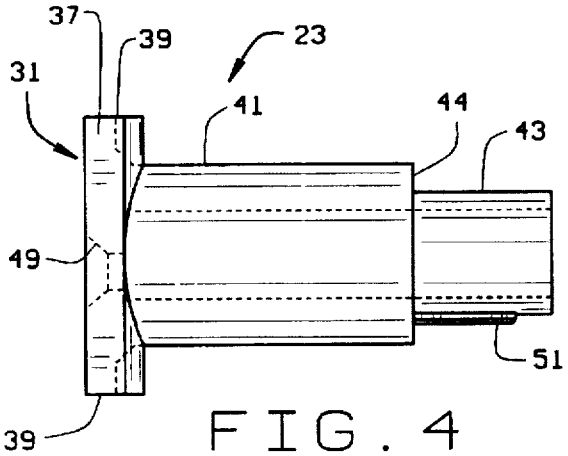
FIG. 4 is a side elevational view of a first portion of the installation aid which is received in the door.
Figure 5:
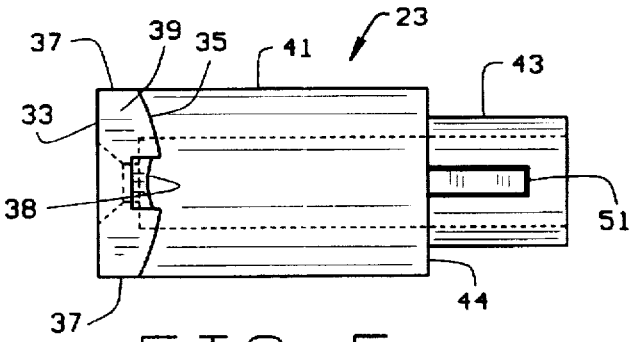
FIG. 5 is a front elevational view of the first portion.

A first post 41 extends from the surface 35 of head 31. Post 41 is preferably cylindrical and has an outer diameter slightly smaller than the diameter of the hole 15 in edge 16 of door 3. The post 41 thus can be slid fairly easily through the hole 15, but will be substantially immovable radially relative to the hole 15. The post 41 has a length substantially equal the length of the hole 15, as seen in FIG. 3. Post 41 is shaped to correspond to the shape of the hole 15. If the hole 15 were, for example, rectangular, then post 41 would be a rectangle rather than a cylinder.

A second and narrower cylindrical post 43 extends forwardly from the end of post 41. Post 43 is concentric with post 41, and the two posts define an annular shoulder 44 at the bottom of post 41. Post 43 is sufficiently long to extend through a gap G between the door 3 and strike jamb 7 and to extend into the jamb hole 17 to be received by the second portion 25. A bore 45, best seen in FIGS. 3, 7, and 8, extends through the first and second posts 41 and 43 to the inner surface 47 of head 31. Bore 45 is preferably of substantially constant diameter.

Figure 6:
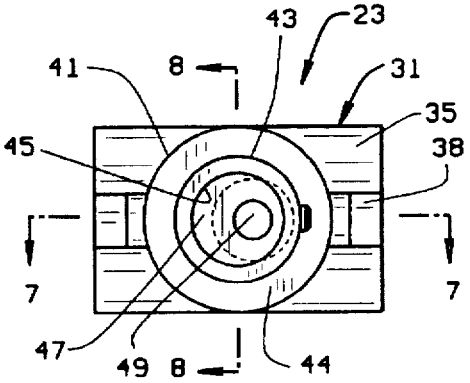
FIG. 6 is a bottom plan view of the first portion.
Figure 7:
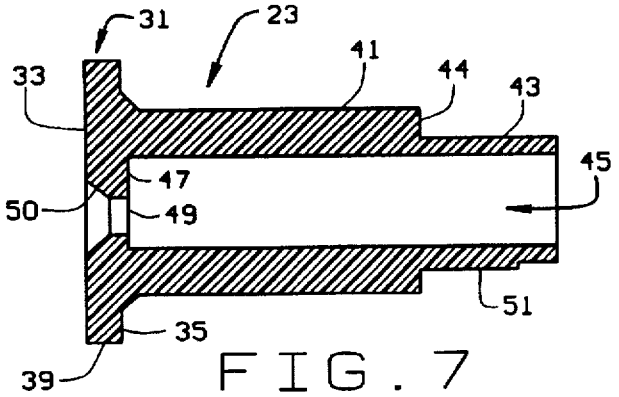
FIG. 7 is a cross-sectional view taken along line 7—7 of FIG. 6.
Figure 8:
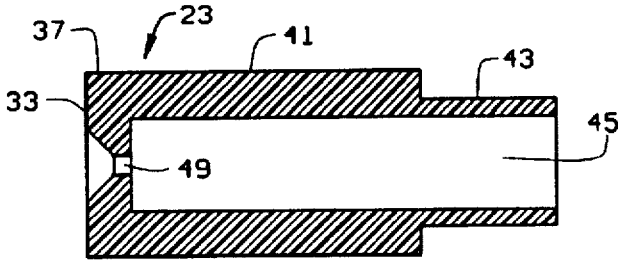
FIG. 8 is a cross-sectional view taken along line 8—8 of FIG. 6.

A screw hole 49 is formed in the head 31 to allow a screw S to be passed through the bore 45. The screw hole 49 preferably has a beveled outer portion 50 so that the head of the screw will be flush with the surface 33 of the head, as shown in FIG. 3. The screw hole 49 is centered on the head between the sides 37, but is off-center with respect to sides 39, as best seen in FIGS. 6 and 7. Thus, as seen in FIG. 6, the screw hole 49 lies on a diameter of the bore 45, but is spaced radially from the center of the bore.

A key 51 may be provided to extend along the outer surface of the second post 43. The key 51 extends from the shoulder 44 approximately ⅓ to ¾ of the length of the second post 43. The key 51 has a height substantially smaller than the width of the shoulder 44.

The second portion 25 is shown in FIGS. 9–13. The second portion 25 includes a generally rectangular base 61 having a back surface 63 and a front surface 65. The base 61 is sized to have a width between its elongate sides 66 no greater than the width of the strike jamb 7. A pair of screw holes 67 extend through the base 61 to facilitate mounting of the second portion 25 to an outer surface of the strike jamb 7. The screw holes preferably are countersunk so that the head of the screws passing through the screw holes 67 will be not extend beyond the back surface 63. Teeth 69 may be provided on the front surface 65 to further facilitate securing the second portion against movement relative to the jamb 7. The base 61 is also provided with a cutout 71 in one of the sides 66 which serves as a guide so that the person who assembles the door assembly 1 will install the second portion 25 in the proper orientation.

Figure 11:
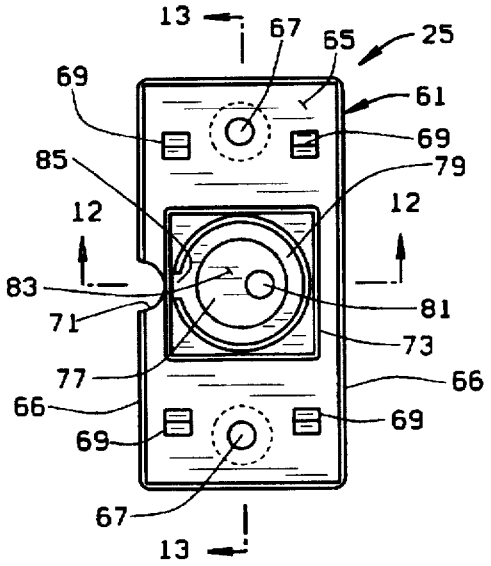
FIG. 11 is a bottom plan view of the second portion.
Figure 9:
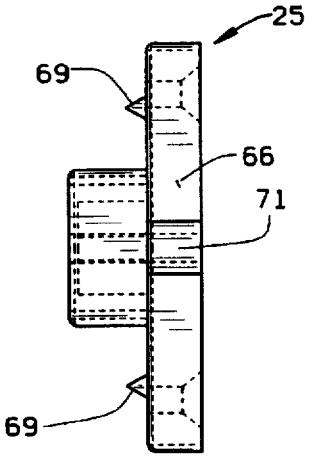
FIG. 9 is a side elevational view of a second portion of the installation aid which is received in the strike jamb of the door assembly.
Figure 10:
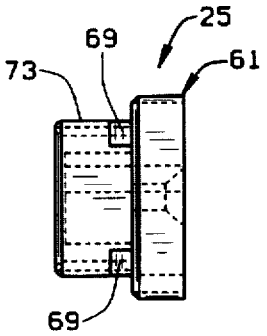
FIG. 10 is a front elevational view of the second portion.
Figure 13:
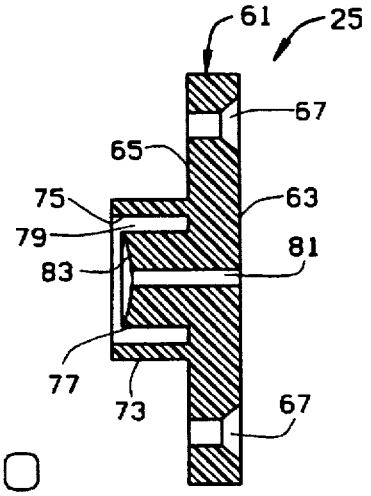
FIG. 13 is a cross-sectional view taken along line 13—13 of FIG. 11.
Figure 12:
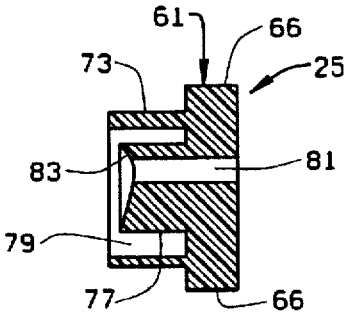
FIG. 12 is a cross-sectional view taken along line 12—12 of FIG. 11.

A post 73 extends perpendicularly from the base top surface 63. The post 73 is generally centered with respect to the base 61 and is shown to be generally square in top plan. This square shape is the common size and shape of the holes 17 in the door jamb. The post 73 is thus sized and shaped to extend into the jamb hole 17. The post 73 is shorter than the jamb hole 17. A circular groove 79 is formed in the top surface 83 of post 73 and forms a cylindrical inner post 77 which extends up from base surface 65 within the post 73. The groove 79 has a radially outer surface 75 The second post 77 is concentric with the wall 75 of the groove 79. The groove 79 is sized and shaped to receive the second post 43 of the first portion 23. Further, the inner post 77 is shorter than the post 73 and has a screw hole 81. Like screw hole 49 of the first portion 23, the screw hole 81 is formed on a diameter of the inner post 77, but is off set from the center of the post, as is best seen in FIG. 11. The top surface 83 of the second post 77 is concave or curved. The concavity or curvature of the surface 83 is shaped to guide a fastener into the screw hole 81. Thus, the deepest point of the curvature of surface 83 is aligned with the center of the screw hole 81. Therefore, in one axis, the surface 83 is symmetrical and in a second axis, the surface 83 is asymmetrical, as seen in FIGS. 12 and 13. Lastly, a key way 85 is formed in the groove 79 and is sized and shaped to receive the key 51 of the first portion 21.

The portion 25 is formed such that the guide notch 71 is formed along one of the elongate sides 66 of the base 61, and is preferably centered with respect to the side of the base. The key way 85 is formed in a portion of the groove 79 adjacent the same wall on which the guide notch 71 is formed. The screw hole 79 is positioned towards the opposite side of the post from the key way 85. Preferably, the guide notch 71, the key way 85, and the screw hole 81 all lie on the same diameter of the inner post 77. Stated differently, the guide notch 71, the key way 85, and the screw hole 81 are generally centered between the top and bottom shorter edges of the base 61.

The first and second portions are preferably molded of plastic and each is formed as a single piece. Thus, the head 31, first post 41, and second post 43 of the first portion 25 are all integrally molded together. Similarly, the base 61, post 73 and inner post 77 are integrally molded together as one piece.

In use, the aid 21 is installed in the door assembly 1 by the manufacturer. After the door assembly 1 has been constructed, the second piece 25 is secured to the outer surface of the strike jamb 11 to cover the strike jamb hole 17 such that its post 73 extends into the hole 17. The second piece 25 is then screwed into place, as seen in FIG. 3. When the second piece 25 is secured into the jamb 11, the teeth 69 will bite into the surface of the jamb to prevent movement of the portion 25 relative to the jamb 7. As noted, the post 73 is shorter than the jamb hole 17, thus, the post will not interfere with the workings of the door knob to hold the door closed once the door assembly has been fully installed in its doorway. The second piece 25 is installed such that its long edges extend vertically along the door jamb 7 and the guide notch 71 is directed to the hinge side of the door, i.e., if the hinges are mounted on the front of the hinge jamb 5, the notch 71 faces the front of the strike jamb 7.

With the door in a closed position and with the door assembly squared, the first piece 23 is passed through the door openings 13 and 15 until the first portion second post 43 is received in the second portion groove 79. When inserting the first portion 23 into the door, it is positioned such that the key 51 will be aligned with and received in the key way 85 of the second portion 25. The use of the key-key way to align the first and second portions 23 and 25 will ensure that the screw holes 49 and 81 are coaxially aligned. The off-set of the screw holes towards one surface of the door facilitates insertion of the screw into the installation aid. If the screw holes were centered between the surfaces of the door, it would be difficult to position a screw driver in the door hole 13 to drive the screw into the installation aid 21. Lastly, with the first and second pieces in place, the screw S is driven through the screw holes 49 and 81 to hold the door closed. The screw holes preferably are not threaded and are formed to be self-tapping. The installation aid 21 will hold the door closed and in its squared position during transportation. If desired, shims or spacers (not shown) can be placed between the door 3 and strike jamb 7 to facilitate maintaining the proper clearance between the door 3 and the jamb 7.

To install the door, the installation aid 21 is left in place in the door assembly 1. Thus, the door assembly 1 is installed with the door closed and in its squared position. Once the door is installed, the screw S can be removed by the installer and the first portion 23 of the aid is removed. The flat blade of a screwdriver can be inserted in the slot 38 to pry the first portion 23 from the second portion 25 if necessary. Such spacers would be sandwiched between the door and door frame and thus fasteners or glue are not needed to hold the spacers in place. The use of spacers will thus not mar the door or door frame. As noted, the second portion 25 stays in place with the door, and hence becomes part of the structure being built. However, the post 71 is sized to be shorter than the door jamb hole 17 so that it will not interfere with the operation of the door knob.

As can be appreciated, the installation aid 21 of the present invention is installed in the door assembly by the manufacturer without marring the door. It thus leaves no visible marks on the door or door frame. The only marks made by the aid 21 to the door frame are on the outer surface of the strike jamb 11 and which are hidden from view by the structure in which the door assembly is installed. Because the second portion 25 of the installation aid remains attached to the outer surface of the strike jamb 11, the door can be kept in its closed position during installation of the door assembly. Thus, all the elements of the frame will be secured in position during installation, and the strike jamb will not be free to move relative to the door during installation. The door assembly, as noted above, can therefore be installed by a single individual. Further, because the door assembly is installed in a doorway in its closed position, the manufacturer can square the door in the door frame prior to shipping. The door assembly, as installed will therefore be squared and the installer will not have to square the door in the door frame. This obviously eliminates a difficult step for the do-it-yourselfer.

As variations within the scope of the appended claims may be apparent to those skilled in the art, the foregoing description is set forth only for illustrative purposes and is not meant to be limiting. For example, the post 71 can be made circular if desired. As long as the groove 79 is shaped and sized to receive the post 43, the posts 41 and 43 of the first portion 23 can be rectangular or any other desired shape. The base 61 of the second portion 25 can be made to be square. The bore 45 is shown to extend through both posts 41 and 43 of the first portion. The bore 45 can be much shorter, and need be only long enough to be received in the groove 79. The first and second portions could be made in the reverse, that is, the first portion could have the groove, and the second portion could have the post which is received in the groove. These examples are merely illustrative.

We claim:

1. An installation aid in combination with a door assembly having a door for maintaining the door closed in the door assembly, the door assembly comprising said door and a door frame, the door frame having a hinge jamb, a strike jamb, and a top jamb, the top jamb extending between and connecting the hinge jamb and strike jamb, the door being hingedly mounted to the hinge jamb; the door having a front surface, back surface, an edge which is proximate the strike jamb when the door is closed, a first hole having a curvature and located near said edge and extending between said front and back surfaces for accepting a door knob assembly and a second hole for a bolt of said door knob assembly and which extends inwardly from said edge and communicates with said first hole; said strike jamb including a hole extending therethrough and which is aligned with said second hole of said door when said door is closed in said door frame;

said installation aid including a first portion, a second portion, and a fastener which removably connects said first and second portions;

said first portion being adapted to be received in said door first hole and to extend through said door second hole; said first portion having a screw hole which is generally parallel to an axis of said second hole of said door;

said second portion being adapted to be secured to an outer surface of said strike jamb to cover said hole of said strike jamb and having a screw hole;

said fastener extending through said first and second portion screw holes to removably connect said first portion to said second portion to maintain said door closed during installation of said door assembly in a structure; said second portion remaining on said strike jamb after said door assembly is installed in the structure.

2. The installation aid of claim 1 wherein said second portion has a groove defining an inner post; said screw hole of said second portion extending through said inner post;

said first portion including a head having a front surface and a back surface, a post extending from said front surface of said head, and a bore in said post, said bore forming an annular wall at an end of said post; said post extending through said second hole of said door when said first portion is applied to the door to be received in said groove of said second portions, said annular wall being sized and shaped to be received in said groove of said second portion, said head of said first portions being larger in circumference than said post of said first portion.

3. The installation aid of claim 2 wherein said second portion inner post has a top surface, said top surface being generally concave.

4. The installation aid of claim 3 wherein said second portion includes a main post extending from said second portion to extend into said hole of said strike jamb when said second portion is applied to the frame, said groove, and hence said inner post, being formed in said main post.

5. The installation aid of claim 3 wherein the concave surface of the second portion inner post has a deepest portion, the second portion screw hole being aligned with the deepest portion of the concave surface.

6. The installation aid of claim 2 wherein the screw hole of said first portion is off-set from a vertical axis of said first portion such that said screw hole will be closer to one of said door front and back surfaces than to the other of said door front and back surfaces when said installation aid is installed in the door.

7. The installation aid of claim 2 wherein said post of said first portion includes a first post and a second post; said first post being sized and shaped to be received in said second hole of said door, said second post being coaxial with said first post and having a circumference smaller than said first post to define a shoulder with said first post.

8. The installation aid of claim 7 wherein said first portion includes a key which extends axially along said second post; said second portion including a key way which receives said key of said first portion, said key and key way being positioned to align said screw hole of said first portion with said second portion screw hole said screw hole of said second portion when said installation aid is installed in the door.

9. The installation aid of claim 2 wherein said front surface of said head of said first portion is curved, the curvature of said head of said first portion conforming to the curvature of said first hole of said door, said head substantially abutting a surface which defines the door first hole along a length of said front surface of said head.

10. The installation aid of claim 9 wherein said head of said first portion includes a slot extending inwardly from a side surface of said head and upwardly from said front surface of said head, said slot being sized to receive a tool to facilitate removal of said first portion from said door after said door has been installed in the structure.

11. An installation aid in combination with a door assembly having a door for maintaining the door closed in the door assembly, the door assembly comprising said door and a door frame in which said door is hingedly mounted; the frame including a strike jamb having an inner surface, an outer surface, and a hole extending between said inner and outer surfaces; the door having a front surface, a back surface, a leading edge, a first hole extending through said door from said front surface to said back surface and being positioned near said leading edge, a second hole extending inwardly from said leading edge and communicating with said first hole; said hole of said strike jamb being aligned with said second hole of said door when said door is closed;

said installation aid including a first portion and a second portion, said first and second portions being connected together when said installation aid is installed in the door assembly to maintain said door closed in said frame during shipment and installation of said door assembly, said second portion remaining on said strike jamb after said door assembly has been installed in a structure;

said first portion extending through said second hole of said door when applied to the door and having a screw hole which is generally parallel to an axis of said second hole of said door;

said second portion when applied to the door being secured to an outer surface of said strike jamb to cover said hole of said strike jamb and having a screw hole.

12. The installation aid of claim 11 wherein the screw hole of said first portion is off-set from a vertical axis of said first portion such that said screw hole will be closer to one of said door front and back surfaces than to the other of said door front and back surfaces when said installation aid is installed in the door.

13. The installation aid of claim 11 wherein the second portion includes a base sized to cover said hole of said strike jamb and a post extending from said base to extend into said hole of said strike jamb when applied to the frame; and said first portion includes a head adapted to be received in said first hole of said door and sized to cover said second hole of said door and a post which extends through said second hole of said door when applied to the door; one of said post of said first portion and said post of said second portion telescopically receiving the other of said posts.

14. The installation aid of claim 13 wherein one of said posts includes a groove and the other of said posts includes a wall which is received in said groove.

15. The installation aid of claim 13 including aligning means for aligning said screw hole of said first portion with said screw hole of said second portion.

16. The installation aid of claim 15 wherein said aligning means includes a key on one of said posts and a key way on the other of said posts; the key and key way being positioned on said first and second portions to axially align said screw holes of said first and second portions when said first and second portions are connected.

17. The installation aid of claim 13 wherein said base of said second portions includes a top, a bottom, and sides; a cutout being formed in one of said base sides to facilitate proper positioning of said second portion on said strike jamb.

18. An installation aid in combination with a pre-hung door assembly for maintaining the pre-hung door assembly closed, the door assembly including a door and a door frame, the door being hingedly mounted to the door frame; said installation aid including a first portion adapted to be received in an existing opening in said door and to extend from an edge of said door, a second portion adapted to extend into an existing opening of the door frame, and a fastener which removably connects said first and second portions to hold the door closed in the door frame during installation of the door assembly in a structure;

said first portion including a head having a front surface and a back surface, a post extending from said front surface of said head, and a bore in said post, said bore forming an annular wall at an end of said post; said head of said first portion being larger in circumference than said post of said first portion, a hole in said head of said first portion, said hole being in communication with said bore and being sized to admit said fastener to pass through said hole into said bore;

said second portion including a head and a post extending from said head, said post of said second portion and said annular wall of said first portion being telescopingly connectable;

said fastener being of a length sufficient to extend from said head of said first portion, through said post of said first portion, said post of said second portion, and to be received in said head of said second portion to hold said first and second portions together.

19. The installation aid of claim 18 wherein said head of said first portion is larger than a preexisting hole in said door and said head of said second portion is larger than a preexisting hole in said frame.

20. The installation aid of claim 18 wherein said hole in said head of said first portion is off-set from a center of said post of said first portion.

21. The installation aid of claim 18 wherein said post of said second portion includes a front surface and a groove in said front surface; said annular wall of said first portion being received in said groove of said second portion.

* * * * *